US011377763B2

(12) United States Patent
Kusudo et al.

(10) Patent No.: US 11,377,763 B2
(45) Date of Patent: Jul. 5, 2022

(54) BRAID

(71) Applicant: KURARAY CO., LTD., Kurashiki (JP)

(72) Inventors: Kazumasa Kusudo, Okayama (JP); Toshiaki Kobayashi, Okayama (JP)

(73) Assignee: KURARAY CO., LTD., Kurashiki (JP)

( * ) Notice: Subject to any disclaimer, the term of this patent is extended or adjusted under 35 U.S.C. 154(b) by 0 days.

(21) Appl. No.: 16/650,113

(22) PCT Filed: Sep. 28, 2018

(86) PCT No.: PCT/JP2018/036355

§ 371 (c)(1),
(2) Date: Mar. 24, 2020

(87) PCT Pub. No.: WO2019/069817

PCT Pub. Date: Apr. 11, 2019

(65) Prior Publication Data

US 2020/0277715 A1 Sep. 3, 2020

(30) Foreign Application Priority Data

Oct. 6, 2017 (JP) ..... JP2017-196331

(51) Int. Cl.
*D04C 1/02* (2006.01)
*D04C 1/12* (2006.01)

(52) U.S. Cl.
CPC ..... *D04C 1/02* (2013.01); *D04C 1/12* (2013.01)

(58) Field of Classification Search
CPC ... D04C 1/02; D04C 1/12; D04C 3/12; D07B 1/025; D07B 1/04
See application file for complete search history.

(56) References Cited

U.S. PATENT DOCUMENTS 3,073,209 A * 1/1963 Benk ..... D07B 1/145 87/6
3,464,459 A * 9/1969 Lee ..... D03D 11/00 139/383 R (Continued)

FOREIGN PATENT DOCUMENTS

CN 101355872 A 1/2009
CN 102869388 A 1/2013

(Continued)

OTHER PUBLICATIONS

Extended European Search Report dated Mar. 26, 2021 in European Patent Application No. 18864845.5, 8 pages.

(Continued)

*Primary Examiner* — Shaun R Hurley
(74) *Attorney, Agent, or Firm* — Oblon, McClelland, Maier & Neustadt, L.L.P.

(57) ABSTRACT

A braid including a core part and a sheath part, wherein the core part includes a high strength fiber (a) having a fineness of 300 to 4,000 dtex and a tensile strength of 12 cN/dtex or more, and the sheath part includes a colored synthetic fiber (b) having a fineness of 60 to 1,000 dtex and a tensile strength of less than 12 cN/dtex. A volume ratio [$a_v/b_v$] of the high strength fiber (a) constituting the core part to the colored synthetic fiber (b) constituting the sheath part is from 73/27 to 40/60. The sheath part has a braid-like structure.

18 Claims, 3 Drawing Sheets

(56) References Cited

U.S. PATENT DOCUMENTS

| | | | | |
|---|---|---|---|---|
| 4,321,854 | A * | 3/1982 | Foote | A01K 91/00 87/6 |
| 5,180,636 | A * | 1/1993 | Harazoe | D04C 1/12 264/210.6 |
| 5,314,446 | A | 5/1994 | Hunter et al. | |
| 6,045,571 | A * | 4/2000 | Hill | A61B 17/06166 606/228 |
| 6,716,234 | B2 * | 4/2004 | Grafton | A61B 17/06166 606/228 |
| 8,522,473 | B2 * | 9/2013 | Nakanishi | D02G 3/38 43/44.98 |
| 10,556,156 | B1 * | 2/2020 | Lambo | D02G 3/38 |
| 2002/0189035 | A1 * | 12/2002 | Ruf | C08L 1/02 8/536 |
| 2005/0149119 | A1 * | 7/2005 | Koyfman | A61B 17/06166 606/228 |
| 2010/0229456 | A1 | 9/2010 | Nakanishi | |
| 2013/0205979 | A1 | 8/2013 | Nelis et al. | |

FOREIGN PATENT DOCUMENTS

| | | | |
|---|---|---|---|
| CN | 203902811 | U | 10/2014 |
| JP | 53-27390 | B2 | 8/1978 |
| JP | 4-300350 | A | 10/1992 |
| JP | 7-278992 | A | 10/1995 |
| JP | 8-109533 | A | 4/1996 |
| JP | 5794354 | B1 | 10/2015 |
| JP | 2016-69742 | A | 5/2016 |
| JP | 3251437 | B2 | 1/2020 |
| WO | WO 2011/135082 | A1 | 11/2011 |

OTHER PUBLICATIONS

Combined Chinese Office Action and Search Report dated Jan. 26, 2021 in corresponding Chinese Patent Application No. 201880064195.2 (with English Translation), 12 pages.

International Search Report dated Dec. 4, 2018, in PCT/JP2018/036355, 1 page.

English translation of the International Preliminary Report on Patentability dated Apr. 8, 2020, in PCT/JP2018/036355, 6 pages.

* cited by examiner

[Fig. 1a]
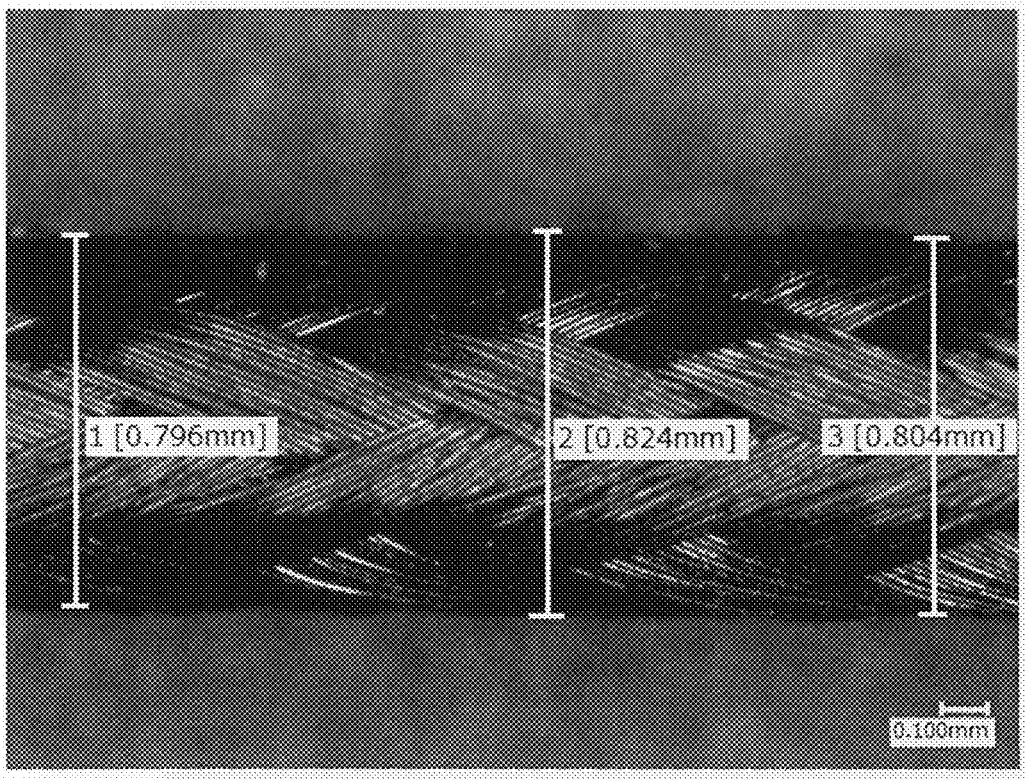
[Fig. 1b]
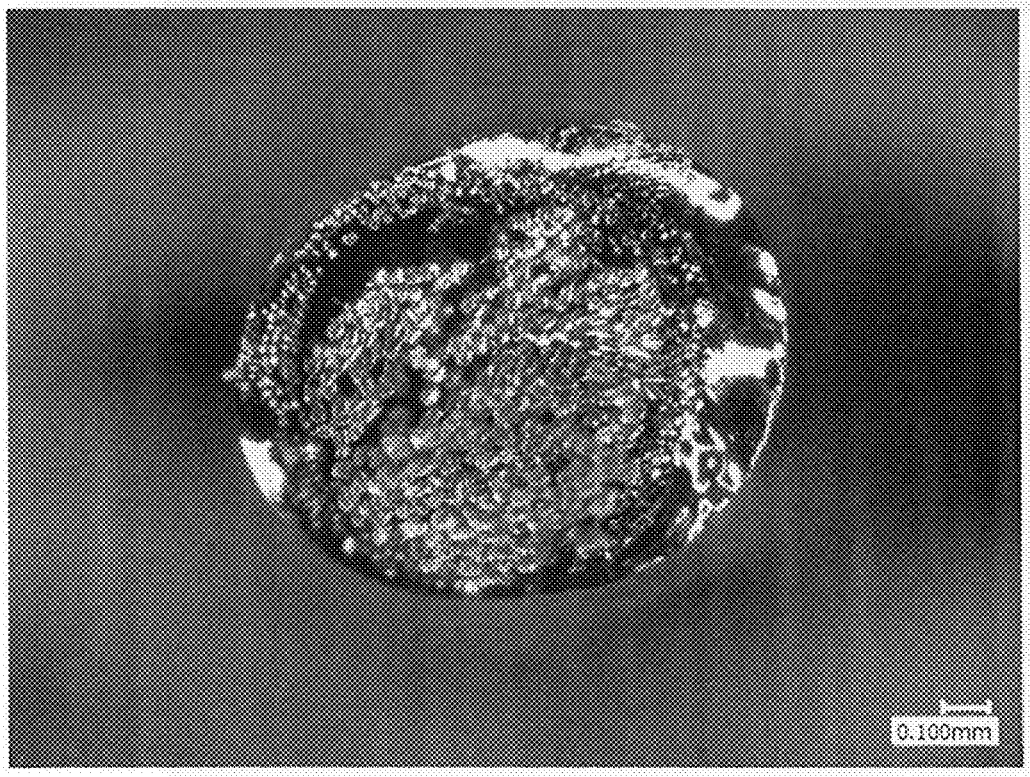

[Fig. 2a]
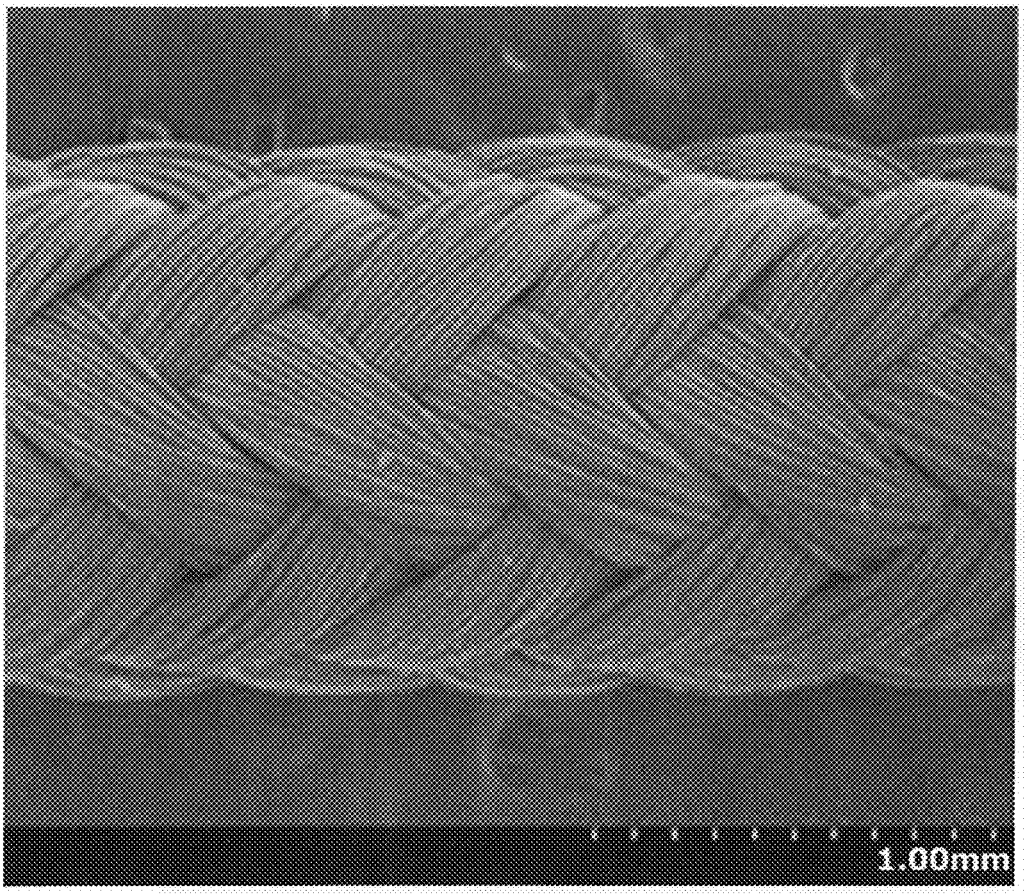
[Fig. 2b]
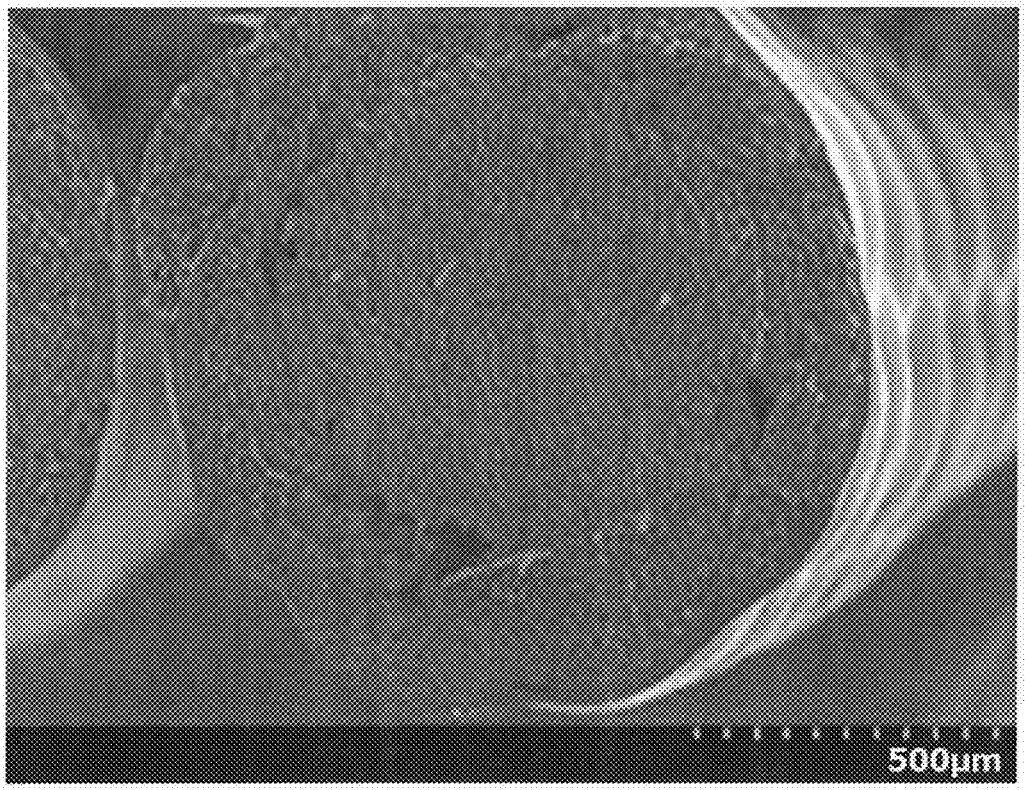

[Fig. 3a]
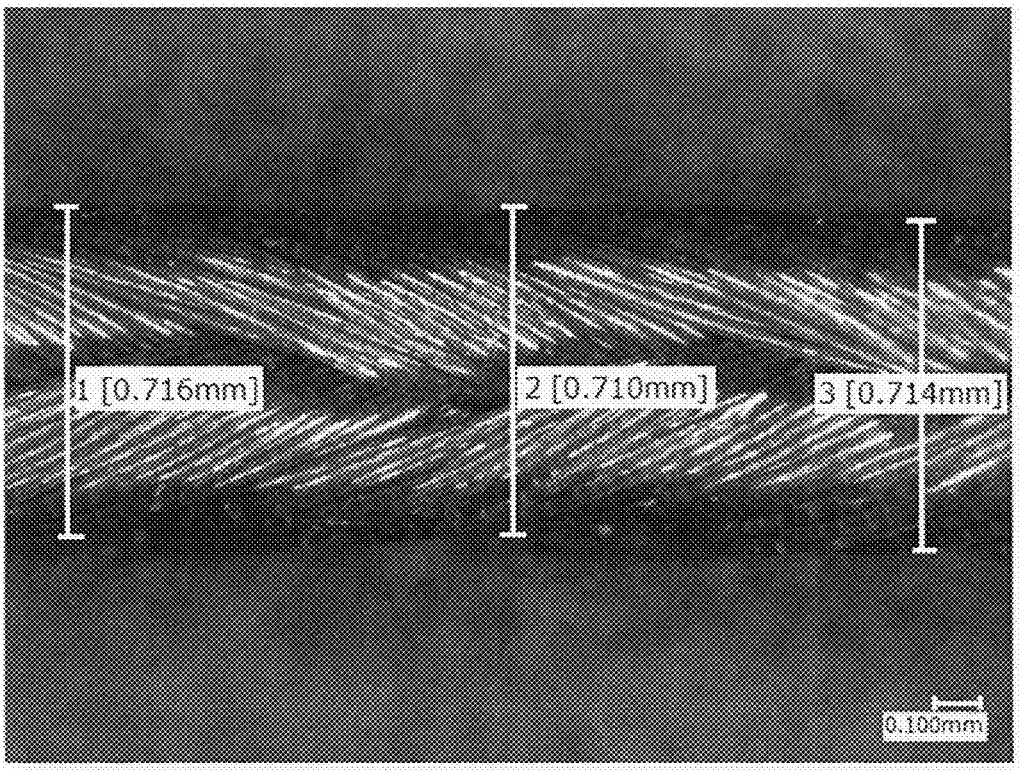
[Fig. 3b]
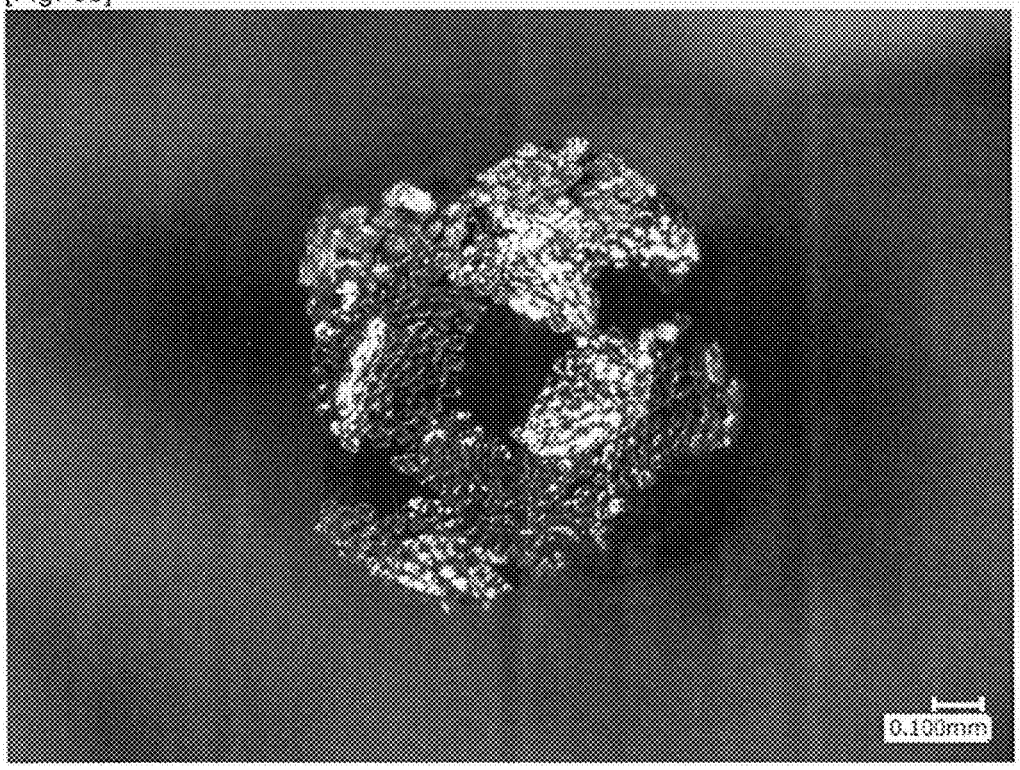

BRAID

TECHNICAL FIELD

The present invention relates to a braid, further relates to a colored braid, and more particularly relates to a braid which is colored and can maintain the strength even when exposed to an ultraviolet ray.

BACKGROUND ART

A braid is used for various applications, for example, fishing lines, nets, blind cords, ropes and the like. With diversification of various applications, these braids are required to have a functionality which is based on a characteristic required by the products.

For example, Patent Document 1 discloses a braid comprising a polyethylene, which is excellent in wear resistance and has high strength and high elastic modulus, by using multi-filaments in which each crystal structure of all monofilaments is made as nearly uniform as possible.

CITATION LIST

Patent Literature

[PTL 1] JP 5794354 B1

SUMMARY OF INVENTION

Technical Problem

With diversification of various applications of a braid, in addition to excellent mechanical strength (high strength and low creep), the braid has been required to be colored in various colors, since design property of the braid can be improved. Also considering outdoor uses, such braid hardly causes reduction in mechanical strength even when exposed to an ultraviolet ray, and is excellent in weatherability, more preferably. The braid hardly causes disappearance of the color even when subjected to mechanical friction, preferably.

Solution to Problem

The present inventors have intensively studied and found that a braid having a specific core-sheath structure, in which a high strength fiber (a) having a specific strength constitutes a core part and a synthetic fiber (b) having a specific strength constitutes a sheath part, has excellent mechanical strength and can be colored in various colors, and preferably hardly causes reduction in mechanical strength even when exposed to an ultraviolet ray, and also hardly causes disappearance of the color even when subjected to mechanical friction. Thus, the present invention has been completed.

Namely, the present invention provides, in an aspect, a braid comprising a core part and a sheath part, wherein the core part comprises a high strength fiber (a) having a fineness of 300 to 4,000 dtex and a tensile strength of 12 cN/dtex or more, and the sheath part comprises a colored synthetic fiber (b) having a fineness of 60 to 1,000 dtex and a tensile strength of less than 12 cN/dtex, and the sheath part has a braid-like structure.

Effects of Invention

A braid according to an embodiment of the present invention comprises a core part and a sheath part, in which the core part comprises a specific high strength fiber (a), the sheath part comprises a colored specific synthetic fiber (b), and the sheath part has a braid-like structure. Therefore, the braid according to the embodiment of the present invention has excellent mechanical strength and can be colored in various colors, and preferably hardly causes reduction in mechanical strength even when exposed to an ultraviolet ray, and also hardly causes disappearance of the applied color even when subjected to mechanical friction.

BRIEF DESCRIPTION OF THE DRAWINGS

FIG. 1*a* shows an optical micrograph of a side of a braid of Example 1.

FIG. 1*b* shows an optical micrograph of a cross section of a braid of Example 1.

FIG. 2*a* shows a SEM image of a side of a braid of Example 2.

FIG. 2*b* shows a SEM image of a cross section of a braid of Example 2.

FIG. 3*a* shows an optical micrograph of a side of a braid of Comparative Example 1.

FIG. 3*b* shows an optical micrograph of a cross section of a braid of Comparative Example 1.

DESCRIPTION OF EMBODIMENTS

In one aspect the present invention provides a novel braid, which is a braid comprising:

a core part and a sheath part, wherein the core part comprises a high strength fiber (a) having a (total) fineness of 300 to 4,000 dtex and a tensile strength of 12 cN/dtex or more, and the sheath part comprises a colored synthetic fiber (b) having a (total) fineness of 60 to 1,000 dtex and a tensile strength of less than 12 cN/dtex, and the sheath part has a braid-like structure.

A braid of a present embodiment comprises a "core part" and a "sheath part".

The "core part" is composed of a braid in which any numbers of monofilaments (namely, multi-filaments) or spun yarns are braided, or a twist string in which any numbers of monofilaments (namely, multi-filaments) or spun yarns are twisted, and the "sheath part" has a braid-like structure which covers the periphery of the core part, and in which any numbers of filaments are braided into forms such as 3 strands, 4 strands, 6 strands, 8 strands, 16 strands, 24 strands, and multi strands. Therefore, the braid of the present embodiment has a core-sheath structure.

Such "core part" comprises a "high strength fiber (a) having a fineness of 300 to 4,000 dtex and a tensile strength of 12 cN/dtex or more".

The "high strength fiber (a)" has "a fineness of 300 to 4,000 dtex and a tensile strength of 12 cN/dtex or more", and is not particularly limited as long as the braid of the present embodiment can be obtained.

Regarding the "high strength fiber (a)", the (total) fineness is preferably in a range of 400 to 3,000 dtex and the fineness is more preferably in a range of 500 to 2,800 dtex, and particularly preferably 600 to 2,300 dtex.

When the fineness of the "high strength fiber (a)" is in the above range, the mechanical strength of the braid is more improved, preferably. Regarding the "high strength fiber (a)", the tensile strength is preferably 17 cN/dtex or more, and more preferably 20 cN/dtex or more. The upper limit of the tensile strength of the "high strength fiber (a)" is not particularly limited, but is commonly 50 cN/dtex or less, may be 40 cN/dtex or less and may be 30 cN/dtex or less.

More specifically, the "high strength fiber (a)" preferably comprises, for example, at least one fiber selected from a group consisting of a liquid crystalline polyester fiber, an aramid fiber, a PBO fiber, an ultra-high molecular weight polyethylene fiber, and a high strength polyvinyl alcohol fiber, more preferably at least one fiber selected from a group consisting of a liquid crystalline polyester fiber and an aramid fiber, and particularly preferably a liquid crystalline polyester fiber.

In an embodiment of the present invention, the "liquid crystalline polyester fiber" can be obtained by melt spinning of a liquid crystalline polyester. The liquid crystalline polyester is composed of a repeating constituting unit, for example, derived from an aromatic diol, an aromatic dicarboxylic acid, or an aromatic hydroxycarboxylic acid. As long as the objective braid of the present invention can be obtained, there is no particular limitation on chemical configuration of the constituting unit derived from an aromatic diol, an aromatic dicarboxylic acid or an aromatic hydroxycarboxylic acid. As long as the objective braid of the present invention can be obtained, the liquid crystalline polyester may comprise a constituting unit derived from an aromatic diamine, an aromatic hydroxyamine, or an aromatic aminocarboxylic acid.

The preferred constituting unit comprises, for example, those shown in Table 1.

TABLE 1

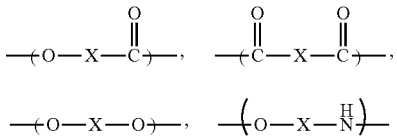

(in which X in the formulas is selected from the following structures)

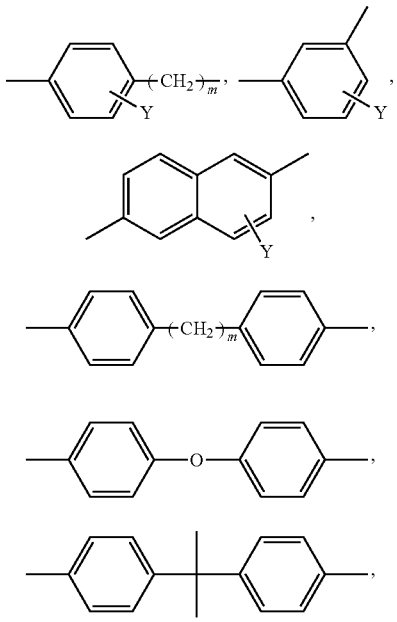

TABLE 1-continued

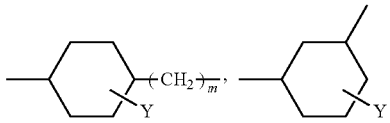

(in which m = 0 to 2, and Y = a substituent selected from a hydrogen atom, a halogen atom, an alkyl group, an aryl group, an aralkyl group, an alkoxy group, an aryloxy group, and an aralkyloxy group)

Number of Y ranges from 1 to the maximum number of substitutable positions in an aromatic ring, and each Y independently represents a hydrogen atom, a halogen atom (for example, a fluorine atom, a chlorine atom, a bromine atom, an iodine atom, etc.), an alkyl group (for example, an alkyl group having 1 to 4 carbon atoms such as a methyl group, an ethyl group, an isopropyl group, or a t-butyl group), an alkoxy group (for example, a methoxy group, an ethoxy group, an isopropoxy group, an n-butoxy group, etc.), an aryl group (for example, a phenyl group, a naphthyl group, etc.), an aralkyl group [a benzyl group (a phenylmethyl group), a phenethyl group (a phenylethyl group), etc.], an aryloxy group (for example, a phenoxy group, etc.), or an aralkyloxy group (for example, a benzyloxy group, etc.).

More preferable constituting unit comprises constituting units mentioned in examples (1) to (18) shown in the below Table 2, Table 3, and Table 4. When the constituting unit in the formulas is a constituting unit which can represent plural structures, two or more constituting units may be used in combination as constituting units constituting a polymer.

TABLE 2

(1)

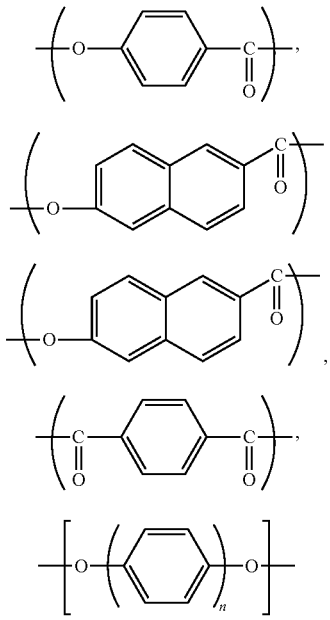

(2)

(3)

TABLE 2-continued
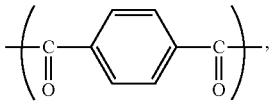
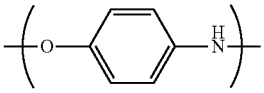
(4)
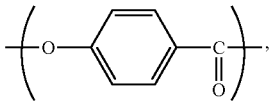
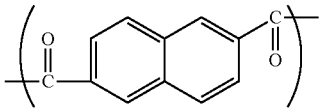
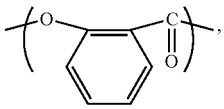
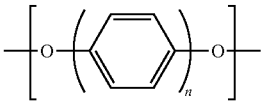
(5)
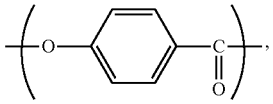
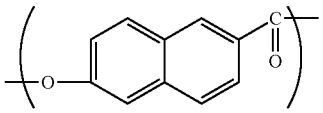
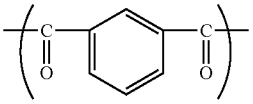
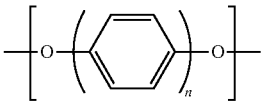
(6)
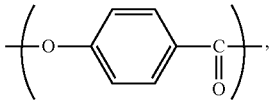
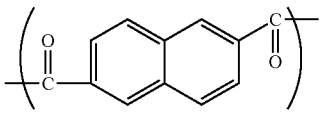
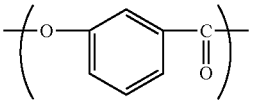
TABLE 2-continued
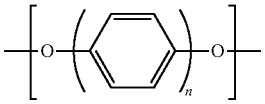
(7)
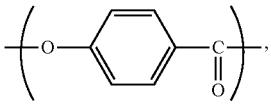
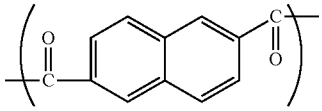
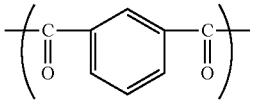
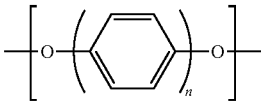
(8)
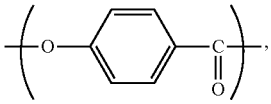
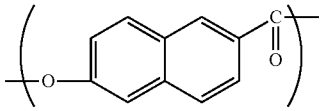
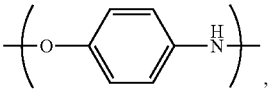
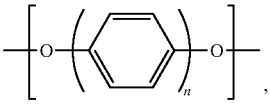
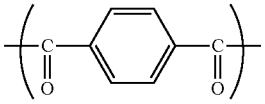
TABLE 3
(9)
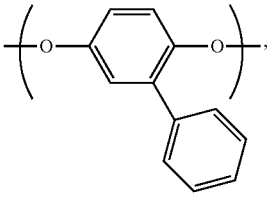
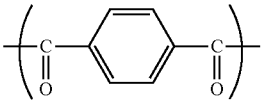

TABLE 3-continued
(10)
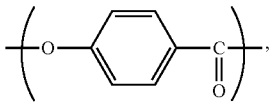
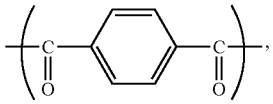
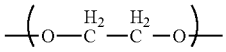
(11)
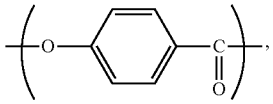
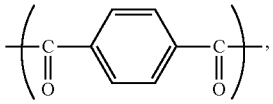
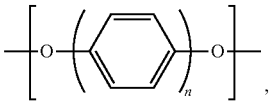
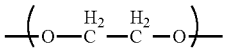
(12)
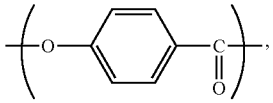
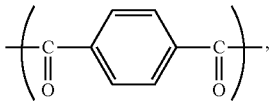
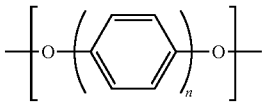
(13)
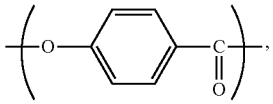
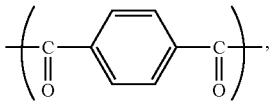
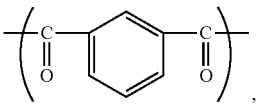
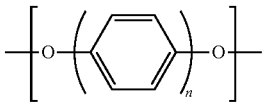
TABLE 3-continued
(14)
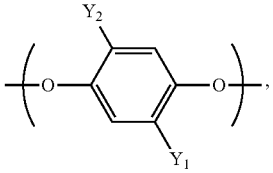
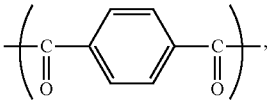
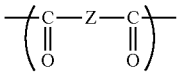
(15)
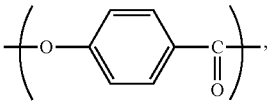
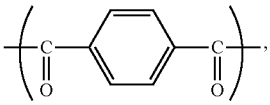
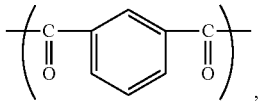
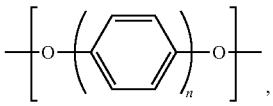
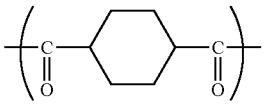
TABLE 4
(16)
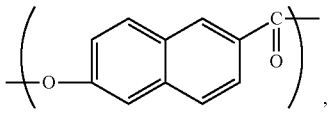
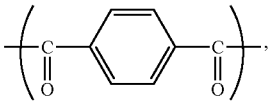
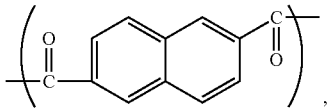
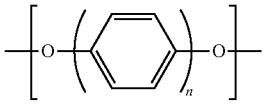

TABLE 4-continued (17)

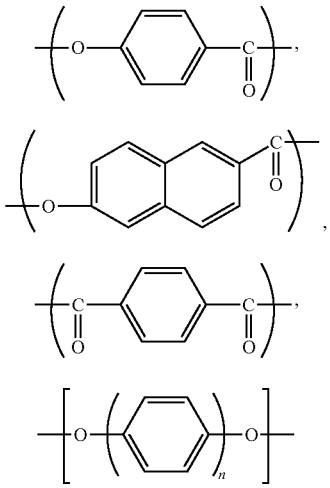

(18)

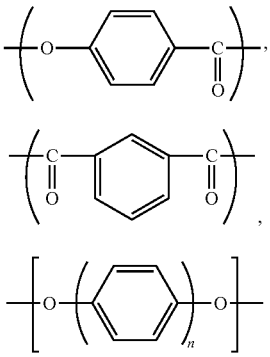

In the constituting units of Table 2, 3, and 4, n is an integer of 1 or 2, and the respective constituting units n=1, n=2 may exist alone or in combination; and $Y_1$ and $Y_2$ each independently may be a hydrogen atom, a halogen atom (for example, a fluorine atom, a chlorine atom, a bromine atom, an iodine atom, etc.), an alkyl group (for example, an alkyl group having 1 to 4 carbon atoms such as a methyl group, an ethyl group, an isopropyl group, or a t-butyl group), an alkoxy group (for example, a methoxy group, an ethoxy group, an isopropoxy group, an n-butoxy group, etc.), an aryl group (for example, a phenyl group, a naphthyl group, etc.), an aralkyl group [a benzyl group (a phenylmethyl group), a phenethyl group (a phenylethyl group), etc.], an aryloxy group (for example, a phenoxy group, etc.), or an aralkyloxy group (for example, a benzyloxy group, etc.). Among these groups, Y is preferably a hydrogen atom, a chlorine atom, a bromine atom, or a methyl group.

Moreover, Z comprises substituents represented by the following formulas.

[Chemical Formula 1]

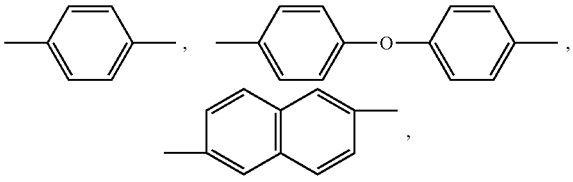

-continued

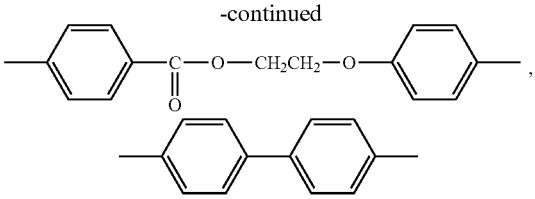

A preferable liquid crystalline polyester may be preferably a combination comprising a naphthalene skeleton as a constituting unit. Particularly preferably, it comprises both a constituting unit (A) derived from hydroxybenzoic acid and a constituting unit (B) derived from hydroxynaphthoic acid. For example, the constituting unit (A) comprises the formula (A) mentioned below and the constituting unit (B) comprises the formula (B) mentioned below. From the viewpoint of improving melt moldability, a ratio of the constituting unit (A) to the constituting unit (B) may be preferably in a range of 9/1 to 1/1, more preferably 7/1 to 1/1, and still more preferably 5/1 to 1/1.

[Chemical Formula 2]

(A)

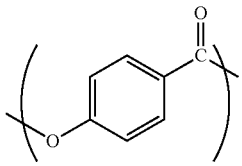

[Chemical Formula 3]

(B)

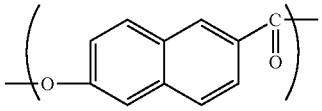

The total of the constituting unit (A) and the constituting unit (B) may be, for example, 65 mol % or more, more preferably 70 mol % or more, and still more preferably 80 mol % or more, based on the total constituting units. A liquid crystalline polyester comprising 4 to 45 mol % of the constituting unit (B) in the polymer is particularly preferable.

A melting point of the liquid crystalline polyester to be suitably used in the present invention is preferably in a range of 250 to 360° C., and more preferably 260 to 320° C. The melting point as used herein is a main absorption peak temperature which is measured and observed by a differential scanning calorimeter (DSC; "TA3000" manufactured by METTLER Co.) in accordance with the JIS K7121 test method. Specifically, 10 to 20 mg of a sample is used in the above-mentioned DSC apparatus and, after the sample is encapsulated in an aluminum pan, nitrogen is allowed to flow as a carrier gas at a flow rate of 100 cc/minute and an endothermic peak upon heating at a rate of 20° C./minute is measured. When a well-defined peak does not appear at the first run in the DSC measurement depending on the type of the polymer, the temperature is raised to a temperature which is 50° C. higher than an expected flow temperature at a temperature rise rate (or heating rate) of 50° C./minute, followed by complete melting at the same temperature for 3 minutes and further cooling to 50° C. at a temperature drop rate (or cooling rate) of −80° C./minute. Thereafter, the endothermic peak may be measured at a temperature rise rate of 20° C./minute.

As long as the objective braid of the present invention is obtained, it is possible to add a thermoplastic polymer such as a polyethylene terephthalate, a modified polyethylene terephthalate, a polyolefin, a polycarbonate, a polyamide, a polyphenylene sulfide, a polyether ether ketone, and a fluorine resin to the above liquid crystalline polyester. The liquid crystalline polyester may also comprise various additives, for example, inorganic substances such as titanium oxide, kaolin, silica, barium sulfate, and carbon black; colorants such as dyes and pigments; antioxidants; ultraviolet absorbers; photostabilizers and the like.

It is possible to use, as a "liquid crystalline polyester fiber", commercially available products. Examples of such commercially available products include Vectran HT Black (trade name) manufactured by KURARAY CO., LTD., Vectran HT (trade name) manufactured by KURARAY CO., LTD., and SIVERAS (trade name) manufactured by Toray Industries, Inc., and Zxion (trade name) manufactured by KB SEIREN, LTD.

The liquid crystalline polyesters can be used alone or in combination.

In an embodiment of the present invention, "aramid fiber" means a polyamide fiber with high heat resistance and high strength comprising a molecular skeleton composed of an aromatic (benzene ring) as long as the objective braid of the present invention can be obtained.

The aramid fiber is roughly classified into a para-aramid fiber and a meta-aramid fiber according to a chemical structure thereof.

The "aramid fiber" preferably comprises a para-aramid fiber.

It is possible to use, as the "aramid fiber", commercially available products. Examples of these commercially available products include para-aramid fibers, for example, Kevlar (trade name) manufactured by DuPont Co., and Twaron (trade name) and Technora (trade name) manufactured by Teijin Limited; and meth-aramid fibers, for example, NOMEX (trade name) manufactured by DuPont Co. and Conex (trade name) manufactured by Teijin Limited.

These aramid fibers can be used alone or in combination.

In an embodiment of the present invention, the "PBO fiber" means a polyparaphenylenebenzobisoxazole (poly(p-phenylene-2,6-benzobisoxazole) fiber and is not particularly limited as long as the objective braid of the present invention can be obtained.

It is possible to use, as the "PBO fiber", commercially available products. Examples of these commercially available products include Zylon AS (trade name) and Zylon HM (trade name) manufactured by TOYOBO CO., LTD.

In an embodiment of the present invention, the "ultra-high molecular weight polyethylene fiber" is not particularly limited as long as the objective braid of the present invention can be obtained. An intrinsic viscosity thereof is preferably in a range of 5.0 to 30 dL/g, more preferably 7.0 to 28 dL/g, and particularly preferably 10 to 24 dL/g. When the intrinsic viscosity of the "ultra-high molecular weight polyethylene fiber" is in a range of 5.0 to 30 dL/g, dimensional stability is more excellent and physical properties fluctuate little with time, and it is easier to mold into a fiber. Furthermore, it is preferably possible to more improve physical properties such as tensile strength and elastic modulus as well as wear resistance.

A weight average molecular weight of the "ultra-high molecular weight polyethylene fiber" is preferably in a range of 700,000 or more and 8,000,000 or less, more preferably 800,000 or more and 7,000,000 or less, and particularly preferably 900,000 or more and 6,000,000 or less. When the weight average molecular weight of the "ultra-high molecular weight polyethylene fiber" is in a range of 700,000 or more and 8,000,000 or less, it is preferably possible to more improve physical properties such as tensile strength and elastic modulus as well as wear resistance. It is preferably easier to mold into a fiber.

It is impossible to easily determine the weight average molecular weight of the "ultra-high molecular weight polyethylene fiber" by a usual GPC method, so that it is possible to determine the weight average molecular weight based on a value of the above mentioned intrinsic viscosity according to the following equation mentioned in "Polymer Handbook Fourth Edition, Chapter 4 (John Wiley, published 1999)".

$$\text{Weight average molecular weight} = 5.365\times10^{4}\times(\text{intrinsic viscosity})^{1.37}$$

It is preferred that a repeating unit of the "ultra-high molecular weight polyethylene fiber" is substantially ethylene. As long as the objective braid of the present invention can be obtained, it is possible to use, in addition to a homopolymer of ethylene, a copolymer of ethylene with a small amount of another monomer, for example, α-olefin, acrylic acid and derivatives thereof, methacrylic acid and derivatives thereof, and vinylsilane and derivatives thereof. As long as the objective braid of the present invention can be obtained, the polyethylene fiber may be a combination of copolymers, a copolymer with an ethylene homopolymer, or a blend with a homopolymer such as another α-olefin. The polyethylene fiber may have a partial crosslinked structure. The polyethylene fiber may also be a blend of a high density polyethylene with an ultra-high molecular weight polyethylene, a blend of a low density polyethylene with an ultra-high molecular weight polyethylene, or a blend of a high density polyethylene, a low density polyethylene with an ultra-high molecular weight polyethylene. The polyethylene fiber may be a combination of two or more ultra-high molecular weight polyethylenes having different weight average molecular weights, or two or more polyethylenes having different molecular weight distributions.

As long as the objective braid of the present invention can be obtained, the content of another monomer such as α-olefin to be used to obtain the "ultra-high molecular weight polyethylene fiber" is not particularly limited. To obtain a fiber having higher strength, the content is preferably 5.0 mol % or less, more preferably 1.0 mol % or less, and particularly preferably 0.2 mol % or less, as a monomer unit. An ethylene homopolymer may be used.

It is possible to use, as the "ultra-high molecular weight polyethylene fiber", commercially available products. Examples of these commercially available products include Dyneema SK60 (trade name), Dyneema SK71 (trade name), IZANAS SK60 (trade name) and IZANAS SK71 (trade name) manufactured by TOYOBO CO., LTD.; and Spectra fiber 900 (trade name) and Spectra fiber 1000 (trade name) manufactured by Honeywell, Ltd.

These "ultra-high molecular weight polyethylene fibers" can be used alone or in combination.

In an embodiment of the present invention, the "high strength polyvinyl alcohol fiber" is not particularly limited as long as the objective braid of the present invention can be obtained and, for example, it is possible to use filaments having a tensile strength of 12 cN/dtex or more using a high polymerization degree polyvinyl alcohol as a raw material. In another example, it is also possible to use a new type polyvinyl alcohol fiber having improved strength and elastic modulus by using a new spinning method such as solvent wet cooled gel spinning.

It is possible to use, as the "high strength polyvinyl alcohol fiber", commercially available products. Examples of these commercially available products include KURALON K-III (trade name) and High Strength Vinylon manufactured by KURARAY CO., LTD.

These "high strength polyvinyl alcohol fibers" can be used alone or in combination.

These "high strength fibers (a)" can be used alone or in combination.

These high strength fibers (a) can suitably comprise various additives, for example, antioxidants, ultraviolet absorbers, photostabilizers and the like.

The "sheath part" of the braid of the present embodiment comprises a "colored synthetic fiber (b) having a fineness of 60 to 1,000 dtex and a tensile strength of less than 12 cN/dtex", and the sheath part has a braid-like structure.

The synthetic fiber (b) has a "fineness of 60 to 1,000 dtex" and a "tensile strength of less than 12 cN/dtex" and is colored, and is not particularly limited as long as the braid of the present embodiment can be obtained.

The "synthetic fiber (b)" preferably has a (total) fineness in a range of 65 to 900 dtex, and more preferably has a fineness in a range of 70 to 800 dtex. When the tensile strength of the "synthetic fiber (b)" becomes higher, the tensile strength of the resulting braid increases preferably. From the viewpoint of moldability (or processability), touch feeling, price and the like, the tensile strength may be 8 cN/dtex or less, or 6 cN/dtex or less. The lower limit of the tensile strength of the "synthetic fiber (b)" is usually 2 cN/dtex or more.

The "synthetic fiber (b)" exists in the sheath part (namely, outside the braid) and is colored, and imparts design property to appearance of the braid and blocks light, thus can prevent the core part from photo-degradation.

The "synthetic fiber (b)" preferably comprises a spun-dyed fiber, and more preferably a spun-dyed fiber containing a pigment or a dye. The synthetic fiber (b) preferably comprises a spun-dyed fiber, since the braid of the present embodiment hardly causes disappearance of the color even when subjected to mechanical friction, and can maintain design property of the braid over a long period.

The "synthetic fiber (b)" can be colored in various colors, for example, black, blue, green, red, yellow, white and a mixed color thereof, and the color can be appropriately selected according to places to be used and one's preference. Coloring in black or white is preferable. In these two colors, coloring in black is more preferable from the view point of blocking light, thus is able to prevent the core part from degradation by light, although there is no particular limitation.

The "synthetic fiber (b)" preferably comprises at least one fiber selected from a group consisting of a polyester fiber, a polyolefin fiber, a polyamide fiber, and a polyvinyl alcohol fiber, more preferably at least one fiber selected from a group consisting of a polyester fiber and a polyamide fiber, and particularly at least one fiber selected from a group consisting of a polyester fiber, from the viewpoint of coloring easily and molding (or processing) easily.

The "polyester fiber" is preferably composed of a polyester-based resin which is different from the above-mentioned "liquid crystalline polyester", and examples of the polyester-based resin include a polyethylene terephthalate-based resin, a polybutylene terephthalate-based resin, a polyethylene naphthalate-based resin, a polybutylene naphthalate-based resin, a poly-1,4-cyclohexanedimethylene terephthalate-based resin, a polycaprolactone-based resin, a polylactic acid-based resin and the like. The polyester fiber is preferably composed of at least one selected from a polyethylene terephthalate-based resin and a polybutylene terephthalate-based resin, and more preferably a polyethylene terephthalate-based resin.

The polyester-based resin constituting a polyester fiber as the synthetic fiber (b) may optionally comprise another dicarboxylic acid unit other than a dicarboxylic acid unit constituting a basic structure, and/or another diol unit other than a diol unit constituting a basic structure, when the content of the another units is 20 mol % or less based on the whole structural units.

It is possible to use, as the "polyester fiber", commercially available products. Examples of these commercially available products include Tetron Dope-Dyed Yarn (trade name) manufactured by Toray Industries, Inc., Clavella Black Spun-Dyed Yarn (trade name) manufactured by KURARAY CO., LTD. and the like.

The synthetic fibers (b) can suitably comprise various additives such as antioxidants, ultraviolet absorbers and light stabilizers.

The sheath part has a braid-like structure and the strand number of the braid-like structure is preferably 8 or more, more preferably in a range of 8 to 24, and particularly preferably 16 to 24.

When the strand number of the braid-like structure of the sheath part is 8 or more, the sheath part has appropriate stretchability (or elasticity). Even when the braid is bent and stretched, the sheath part flexibly follows the bending and stretching, and can cover the core part without exposure of the core part.

A volume ratio $[a_v/b_v]$ of the high strength fiber (a) constituting the core part and the synthetic fiber (b) constituting the sheath part is preferably in a range of 80/20 to 30/70, and more preferably 73/27 to 40/60.

When the volume ratio $[a_v/b_v]$ of the high strength fiber (a) constituting the core part to the synthetic fiber (b) constituting the sheath part is in the above range, the braid of the present embodiment has more excellent mechanical strength and hardly causes reduction in mechanical strength even when exposed to an ultraviolet ray, and is excellent in weatherability, preferably. Meanwhile, when the volume ratio $[a_v/b_v]$ is less than the above range, there are some cases where the braid cannot attain desired strength and cannot maintain practically sufficient mechanical strength. Meanwhile, when the volume ratio $[a_v/b_v]$ exceeds the above range, there are some cases it is impossible to suppress reduction in mechanical strength when exposed to an ultraviolet ray and to maintain practically sufficient weatherability.

A diameter of the braid of the present embodiment is preferably 1.5 mm or less, more preferably in a range of 0.5 to 1.5 mm, and particularly preferably 0.8 to 1.2 mm.

In the braid of the present embodiment, since the high strength fiber (a) having a fineness of 300 to 4,000 dtex and a tensile strength of 12 cN/dtex or more is used as a core part, practically sufficient mechanical strength can be maintained even when the diameter is made thin.

A strength (before light irradiation) of the braid of the present embodiment is preferably 550 N or more, more preferably 600 N or more, and particularly preferably 800 N or more. The upper limit is not particularly limited and the higher, the better. The upper limit is usually 1,100 N or less.

Regarding the braid of the present embodiment, a strength retention rate (after a light fastness test for 50 hours) is preferably 90.0% or more, and more preferably 92.0% or more. When the strength retention rate (after a light fastness test for 50 hours) is in the above range, the braid of the present embodiment is excellent in weatherability.

Regarding the braid of the present embodiment, creep strains after 1 hour and 24 hours under a load of 250 N (before light irradiation) are preferably 8.0% or less, more preferably 5.0% or less, and particularly preferably 3.0% or less. The lower limit is not particularly limited and the lower, the better. For example, the lower limit is 1% or more.

Regarding the braid of the present embodiment, creep strains after 1 hour and 24 hours under a load of 250 N (after a light fastness test for 50 hours) are preferably 8.0% or less, more preferably 5.0% or less, and particularly preferably 3.0% or less. The lower limit is not particularly limited and the lower, the better. For example, the lower limit is 1.0% or more.

The braid of the present embodiment has a core-sheath structure and the synthetic fiber (b) constituting the sheath part is colored, thus the high strength fiber (a) as the core part can be protected from irradiation with an ultraviolet ray, and high strength retention rate and low creep strain can be maintained even after a light fastness test for 50 hours.

The present invention provides, in another aspect, a fiber product comprising the braid of the present embodiment. Such fiber product is not particularly limited as long as the braid of the present embodiment can be used. Examples thereof include protective materials, surgical sutures, fastening filaments for meat, safety gloves, safety ropes, ropes for fishery industries, finishing ropes, archery strings, base materials for collecting organic and inorganic matters by making composites with various materials, bases for water retention, one-touch laces, shoelaces, straps, interior cords and nets such as blind cords, pleated cords, pleated screen door cords, curtain cords, and shading screens and the like.

EXAMPLES

The present invention will be described in more detail and specific manner by way of Examples and Comparative Examples. These Examples are exemplary of the present invention and are not to be considered as limiting.

Materials used in the present Example are shown below.

High Strength Fiber (a) Having a Tensile Strength of 12 cN/Dtex or More (a1) Liquid crystalline polyester fiber (black) (multifilament) having a tensile strength of 17 cN/dtex and a total fineness of 560 dtex, and a specific gravity of 1.41 g/cm$^3$ ("Vectran HT Black" manufactured by KURARAY CO., LTD.)

(a2) Liquid crystalline polyester fiber (transparent) (multifilament) having a tensile strength of 24 cN/dtex, a total fineness of 1,670 dtex, and a specific gravity of 1.41 g/cm$^3$ ("Vectran HT" manufactured by KURARAY CO., LTD.)

(a3) Liquid crystalline polyester fiber (black) (multifilament) having a tensile strength of 23 cN/dtex, a total fineness of 1,670 dtex, and a specific gravity of 1.41 g/cm$^3$ ("Vectran HT Black" manufactured by KURARAY CO., LTD.)

(a4) Ultra-high molecular weight polyethylene fiber (black) (multifilament) having a tensile strength of 26.6 cN/dtex, a total fineness of 1,670 dtex, and a specific gravity of 0.97 g/cm$^3$ ("Dyneema (registered trademark) SK60" manufactured by TOYOBO CO., LTD.)

(a5) Aramid fiber (black) (multifilament) having a tensile strength of 20 cN/dtex, a total fineness of 1,670 dtex, and a specific gravity of 1.44 g/cm$^3$ ("Kevlar 29" manufactured by DuPont Co.)

(a6) Aramid fiber (black) (multifilament) having a tensile strength of 20 cN/dtex, a total fineness of 560 dtex, and a specific gravity of 1.44 g/cm$^3$ ("Kevlar 29" manufactured by DuPont Co.)

(a7) Ultra-high molecular weight polyethylene fiber (black) (multifilament) having a tensile strength of 26.6 cN/dtex, a total fineness of 560 dtex, and a specific gravity of 0.97 g/cm$^3$ ("Dyneema (registered trademark) SK60" manufactured by TOYOBO CO., LTD.)

Synthetic Fiber (b) Having a Strength of Less than 12 cN/Dtex (b1) Polyethylene terephthalate (PET) fiber (black) (multifilament) having a tensile strength of 3.5 cN/dtex, a total fineness of 77 dtex, and a specific gravity of 1.38 g/cm$^3$ ("Clavella black spun-dyed (containing 2% black pigment added)" manufactured by KURARAY CO., LTD.)

(b2) Polyethylene terephthalate (PET) fiber (black) (multifilament) having a tensile strength of 3.5 cN/dtex, a total fineness of 220 dtex, and a specific gravity of 1.38 g/cm$^3$ ("Clavella black spun-dyed (containing 2% black pigment added)" manufactured by KURARAY CO., LTD.)

(b3) Polyethylene terephthalate (PET) fiber (black) (multifilament) having a tensile strength of 10 cN/dtex, a total fineness of 110 dtex, and a specific gravity of 1.38 g/cm$^3$ ("Clavella black spun-dyed (containing 2% black pigment added)" manufactured by KURARAY CO., LTD.)

(b4) Polyethylene terephthalate (PET) fiber (white) (multifilament) having a tensile strength of 2.8 cN/dtex, a total fineness of 77 dtex, and a specific gravity of 1.38 g/cm$^3$ (White pigment (titanium oxide) is added to PET in an amount of 2.5%.)

(b5) Polyethylene terephthalate (PET) fiber (not colored) (multifilament) having a tensile strength of 2.7 cN/dtex, a total fineness of 77 dtex, and a specific gravity of 1.38 g/cm$^3$ (A transparent (not colored) triazine-based ultraviolet absorber is added to PET in an amount of 0.5%.)

(b6) Polyethylene terephthalate (PET) fiber only (not colored) (multifilament) having a tensile strength of 2.7 cN/dtex, a total fineness of 77 dtex, and a specific gravity of 1.38 g/cm$^3$

Coating (c)

(c1) Epoxy resin coating agent ("Epoxy Sizing Agent VE35" manufactured by Matsumoto Yushi-Seiyaku Co., Ltd.)

(c2) Urethane resin coating agent ("Superflex 126" manufactured by DAI-ICHI KOGYO SEIYAKU CO., LTD.)

Using a known braider (braiding machine), a high strength fiber (a) with a strand number (or a number of strand) shown in Tables 5 to 6 was used to form a core part, and then a synthetic fiber (b) with a strand number shown in Tables 5 to 6 was used to form a braid structure of a sheath part on the periphery of the core part, thus producing braids of Examples 1 to 8 and Comparative Examples 1 to 3, 6 to 7.

Furthermore, a high strength fiber (a) with a strand number shown in Table 6 was used to form a core part, and then a coating (c) shown in Table 6 was applied on the periphery of the core part, followed by DIP-NIP and further drying to form a coating, thus producing braids of Comparative Examples 4 to 5.

With respect to the above respective braids, diameter, strength (N), creep (strain (%) after 1 hour under a load of 250 N, and strain (%) after 24 hours under a load of 250 N), and light fastness (or light resistance) were measured by the following procedures and then evaluated.

The results are shown in Tables 5 to 6.

Diameter

Fibers of a braid were fixed by using wood glue and cut in a direction of a cross section, and widths at three points on a side were observed using a digital microscope VHX-2000 (trade name) manufactured by KEYENCE CORPORATION. An average value of the three values at the three points was calculated to obtain diameter of the braid.

Colorability

Regarding the braids comprising a core part and a sheath part of Examples 1 to 8, an easily colored braid can be obtained by coloring a fiber (b) of a sheath part. Even when the braid undergoes mechanical friction and wear, since the fiber (b) is colored, there is little fluctuation in colorability.

Meanwhile, in Comparative Examples 1 to 3, there is no sheath part, so that a fiber (a) of a core part must be colored. Coloring can lead to large fluctuation in high mechanical properties possessed by the fiber (a) of the core part. In Patent Document 1, attention should be paid to the fact that the high mechanical strength is realized by employing a specific crystal structure.

In Comparative Examples 4 to 5, a core part is covered with a coating, but the coating can be damaged by bending of a braid, so that that is still not enough.

With regard to the braids having a sheath part and a core part of Comparative Examples 6 to 7, the fibers (b) of the sheath part are transparent, and the fibers (b) of the sheath part are not colored. Therefore, it is necessary to color the braids of Comparative Examples 6 to 7. For example, it is seemed that the outside of the braids should be colored with coating and the like. Such coating is insufficient since it can be damaged similarly to Comparative Examples 4 to 5.

Strength (N)

Strength was determined in accordance with JIS L1013.

Creep (Strain (%) after 1 Hour Under a Load of 250 N, and Strain (%) after 24 Hours Under a Load of 250 N)

Using 525-R CREEP TESTER (product name) manufactured by MYS-TESTER Company Limited, strain was measured after a predetermined time passed under a load of 250 N.

Light Fastness Test (Xenon Light Irradiation Treatment)

In the present specification, a light fastness (or resistance) test was performed with reference to "JIS L0891 Test method for accelerated weathering fastness with xenon arc lamp light or sunshine carbon arc lamp light" using SX75 light fastness test machine (product name) manufactured by Suga Test Instruments Co., Ltd. defined in "JIS B7754 Xenon-arc lamp type light fastness and light fastness test machine" under the conditions of light source: one 7.5 kw water-cooled xenon lamp, radiation: 180 W/m$^2$ (300 to 400 nm), temperature: 63° C.±2° C., rainfall: rainfall for 18 minutes among 120 minutes, and irradiation time: 50 hours. After the test, strength and creep (strain after 1 hour under a load of 250 N, and strain after 24 hours under a load of 250 N) were measured. A strength retention rate was also calculated.

Optical Microscopic Observation

States of a side and a cross section of the braids of Example 1 and Comparative Example 1 were observed by a digital microscope VHX-2000 (product name) optical microscope manufactured by KEYENCE CORPORATION. A photographing magnification of the side was 175 times and a photographing magnification of the cross section was 175 times.

Electron Microscopic Observation

States of a side and a cross section of the braid of Example 2 were observed by S-3400 N (product name) scanning electron microscope manufactured by Hitachi High-Technologies Corporation. An accelerating voltage was about 15 kV, a photographing magnification of the side was 50 times, and a photographing magnification of the cross section was 75 times.

TABLE 5

| | Examples | | | | | | | |
|---|---|---|---|---|---|---|---|---|
| | 1 | 2 | 3 | 4 | 5 | 6 | 7 | 8 |
| Core (A) | | | | | | | | |
| (a1) (Strand number) | 6 | | | 6 | | | | 6 |
| (a2) | | 2 | | | | | | |
| (a3) | | | 2 | | | | | |
| (a4) | | | | | 2 | | | |
| (a5) | | | | | | 2 | | |

TABLE 5-continued

| | Examples | | | | | | | |
|---|---|---|---|---|---|---|---|---|
| | 1 | 2 | 3 | 4 | 5 | 6 | 7 | 8 |
| (a6) | | | | | | | 6 | |
| (a7) | | | | | | | | |
| Fineness of core | 3,360 | 3,340 | 3,340 | 3,360 | 3,340 | 3,340 | 3,360 | 3,360 |
| Sheath (B) | | | | | | | | |
| (b1) (Strand number) | 16 | | | | | | | |
| (b2) | | 16 | | 16 | | | 16 | |
| (b3) | | | 16 | | 16 | 16 | | |
| (b4) | | | | | | | | 16 |
| Fineness of sheath | 1,232 | 3,520 | 1,760 | 3,520 | 1,760 | 1,760 | 3,520 | 1,248 |
| Coating (C) | | | | | | | | |
| A/B (weight ratio) | 73/27 | 49/51 | 65/35 | 49/51 | 65/35 | 65/35 | 49/51 | 73/27 |
| A/B (volume ratio) | 73/27 | 49/51 | 65/35 | 49/51 | 73/27 | 64/36 | 48/52 | 73/27 |
| Diameter (mm) | 0.81 | 1.16 | 1.00 | 0.98 | 1.09 | 0.96 | 0.98 | 0.81 |
| Colorability | Good | Good | Good | Good | Good | Good | Good | Good |
| Before light irradiation | | | | | | | | |
| Strength (N) | 634 | 942 | 886 | 706 | 1,073 | 655 | 530 | 636 |
| Creep (%) | | | | | | | | |
| Strain after 1 hour | 1.7 | 2.3 | 2.4 | 2.5 | 7.7 | 5.0 | 5.1 | 1.7 |
| Strain after 24 hours | 2.2 | 2.3 | 2.4 | 2.5 | 8.6 | 5.1 | 5.2 | 2.2 |
| After 50 hours light irradiation | | | | | | | | |
| Strength (N) | 593 | 892 | 824 | 660 | 998 | 609 | 400 | 582 |
| Strength retention ratio | 93.5 | 94.8 | 93.0 | 93.5 | 93.0 | 93.0 | 90.8 | 91.5 |
| Creep (%) | | | | | | | | |
| Strain after 1 hour | 2.2 | 2.1 | 2.2 | 2.6 | 9.7 | 5.0 | 5.1 | 2.2 |
| Strain after 24 hours | 2.3 | 2.1 | 2.2 | 2.6 | 11.2 | 5.2 | 5.3 | 2.3 |

TABLE 6

| | Comparative Examples | | | | | | |
|---|---|---|---|---|---|---|---|
| | 1 | 2 | 3 | 4 | 5 | 6 | 7 |
| Core (A) | | | | | | | |
| (a1) (Strand number) | 8 | 6 | | 8 | 8 | 6 | 6 |
| (a2) | | | | | | | |
| (a3) | | | | | | | |
| (a4) | | | | | | | |
| (a5) | | | | | | | |
| (a6) | | | | | | | |
| (a7) | | | 8 | | | | |
| Fineness of core | 4,480 | 3,360 | 4,480 | 4,480 | 4,480 | 3,360 | 3,360 |
| Sheath (B) | | | | | | | |
| (b1) (Strand number) | | | | | | | |
| (b2) | | | | | | | |
| (b3) | | | | | | | |
| (b5) | | | | | | 16 | |
| (b6) | | | | | | | 16 |
| Fineness of sheath | | | | | | 1,232 | 1,216 |
| Coating (C) | | | | (c1) | (c2) | | |
| A/B (weight ratio) | 100/0 | 100/0 | 100/0 | 100/0 | 100/0 | 73/27 | 73/27 |
| A/B (volume ratio) | 100/0 | 100/0 | 100/0 | 100/0 | 100/0 | 73/27 | 73/27 |

TABLE 6-continued

| | Comparative Examples | | | | | | |
|---|---|---|---|---|---|---|---|
| | 1 | 2 | 3 | 4 | 5 | 6 | 7 |
| Diameter (mm) | 0.71 | 0.91 | 0.98 | 0.83 | 0.74 | 0.81 | 0.81 |
| Colorability | Bad | Bad | Bad | Bad | Bad | Bad | Bad |
| Before light irradiation | | | | | | | |
| Strength (N) | 678 | 569 | 565 | 587 | 564 | 634 | 634 |
| Creep (%) | | | | | | | |
| Strain after 1 hour | 3.8 | 2.4 | 7.0 | 2.0 | 4.0 | 1.7 | 1.7 |
| Strain after 24 hours | 3.9 | 2.4 | 7.8 | 2.0 | 4.0 | 2.2 | 2.2 |
| After 50 hours light irradiation | | | | | | | |
| Strength (N) | 470 | 195 | 488 | 413 | 479 | 493 | 437 |
| Strength retention ratio | 69.3 | 34.4 | 86.4 | 70.3 | 84.9 | 77.8 | 69.0 |
| Creep (%) | | | | | | | |
| Strain after 1 hour | 5.0 | >20 | 3.8 | 2.5 | 4.1 | 3.2 | 4.5 |
| Strain after 24 hours | 5.0 | — | 10.2 | 2.6 | 4.2 | 3.6 | 4.7 |

Each of the braids of Examples 1 to 8 comprises a core part and a sheath part. The braid has a color, and a chemical fiber of the sheath part is colored. Each of the braids exhibits excellent properties and exhibits a high strength retention rate even after light irradiation.

Each of the braids of Example 1 to 4, 8 uses a liquid crystalline polyester fiber in the core part (a), and exhibits more preferably large strength and small creep (strain) even after light irradiation.

The braid of Example 5 uses an ultra-high molecular weight polyethylene fiber in the core part (a), and exhibits large strength compared to those of Examples 1 to 4, but is inferior in creep (strain) compared to those of Examples 1 to 4.

Each of the braids of Examples 6 to 7 uses a wholly aromatic polyamide fiber in the core part (a), and is inferior in strength and creep (strain) compared to those of Examples 1 to 4, but is excellent in creep (strain) compared to that of Example 5.

An optical microscope image of a side of the braid of Example 1 is shown in FIG. 1*a*, and an optical microscope image of a cross section is shown in FIG. 1*b*. It is shown that multi-filaments of the core part are covered with multi-filaments at the sheath part where a braid-like structure is formed. Both of the multi-filaments of the core part and the sheath part are colored in black, thus light can be prevented from entering into the multi-filaments of the core part. The surface of the sheath part of FIG. 1 appears gray. However, the actual color of the surface is black, while the surface appears gray due to reflection on the black surface.

A diameter of the braid of Example 1 was obtained by averaging three values obtainable by measuring width at three points on a side of the braid of Example 1. In FIG. 1*a*, three values of 0.796 mm, 0.824 mm and 0.804 mm were obtained, and averaged to give 0.81 mm as the diameter of the braid of Example 1. Moreover, one scale mark of the scale ratio indicated on the lower right of FIGS. 1*a* and 1*b* shows 0.100 mm length.

A SEM image of a side of the braid of Example 2 is shown in FIG. 2*a*, and a SEM image of a cross section of that of Example 2 is shown in FIG. 2*b*. It is shown that multi-filaments of the core part are covered with multi-filaments at the sheath part where a braid-like structure is formed. The multi-filaments of the sheath part are colored in black, thus light can be prevented from entering into the multi-filaments of the core part. Because FIGS. 2*a* and 2*b* are SEM images, the black color of the braid is not shown.

An optical microscope image of a side of the braid of Comparative Example 1 is shown in FIG. 3*a*, and an optical microscope image of a cross section of that of Comparative Example 1 is shown in FIG. 3*b*. Only multi-filaments of the core part are observed and are not covered with a sheath part. The multi-filaments of the core part are colored in black.

A diameter of the braid of Comparative Example 1 was measured and obtained by using a method similar to the method shown in Example 1. In FIG. 3*a*, three values of 0.716 mm, 0.710 mm and 0.714 mm were obtained, and averaged to give 0.71 mm as the diameter of the braid of Comparative Example 1. Moreover, one scale mark of the scale ratio indicated on the lower right of FIGS. 3*a* and 3*b* shows 0.100 mm length.

In Comparative Examples 1 to 2, a liquid crystalline polyester fiber is used. The strength after light irradiation drastically decreased, and the creep drastically increased.

Comparative Example 3 is an example in which an ultra-high molecular weight polyethylene fiber is used.

Comparative Examples 4 to 5 are examples in which a coating (c) (more specifically, (c1) or (c2)) is applied to a fiber (a). It is apparent that the strength retention rate is not necessarily sufficient after light irradiation.

Both Comparative Examples 6 to 7 are braids comprising a core part and a sheath part. Since the synthetic fibers (b) of the sheath part of the braids are not colored, the braids are transparent and not colored. Therefore, it is necessary to color (for example, to coat) the braids, and it is apparent that the colorabilities of the braids are bad. Moreover, the strengths after light irradiation and the like of the braids of Comparative Examples 6 to 7 are not sufficient compared to those of Examples 1 and 8.

As evident from the above, a braid comprising a core part and a sheath part, wherein the core part comprises a specific high strength fiber (a), the sheath part comprises a colored specific synthetic fiber (b) and the sheath part has a braid-like structure, has excellent mechanical strength and can be colored variously, and preferably hardly causes reduction in mechanical strength even when exposed to an ultraviolet ray, and hardly causes disappearance of the color even when subjected to mechanical friction.

INDUSTRIAL APPLICABILITY

A braid according to an embodiment of the present invention has excellent mechanical strength and can be colored in various colors, and preferably hardly causes reduction in mechanical strength even when exposed to an ultraviolet ray, and hardly causes disappearance of the color even when subjected to mechanical friction.

A fiber product comprising the braid of the present embodiment can be used for various applications, for example, protective materials, surgical sutures, fastening filaments for meat, safety gloves, safety ropes, ropes for fishery industries, finishing ropes, archery strings, base materials for collecting organic and inorganic matters by making composites with various materials, bases for water retention, one-touch laces, shoelaces, straps, interior cords and nets such as blind cords, pleated cords, pleated screen door cords, curtain cords, and shading screens and the like.

CROSS-REFERENCE TO RELATED APPLICATION

The present application claims benefit under Paris Convention of Japanese Patent Application No. 2017-196331 filed on Oct. 6, 2017, incorporated herein by reference in its entirety.

The invention claimed is:

1. A braid comprising:

a core part comprising a high strength fiber (a) having a fineness of 300 to 4,000 dtex and a tensile strength of 12 cN/dtex or more; and a sheath part comprising a synthetic fiber (b) having a fineness of 60 to 1,000 dtex and a tensile strength of less than 12 cN/dtex, wherein the synthetic fiber (b) is colored such that the sheath part blocks light reaching the core part, a volume ratio [$a_v/b_V$] of the high strength fiber (a) constituting the core part to the colored synthetic fiber (b) constituting the sheath part is in a range of 73/27 to 40/60, and the sheath part has a braid-like structure.

2. The braid according to claim 1, wherein a diameter of the braid is 1.5 mm or less.

3. The braid according to claim 1, wherein a strength of the braid is 550 N or more.

4. The braid according to claim 1, wherein a strand number of the braid-like structure of the sheath part is 8 or more.

5. The braid according to claim 1, wherein creep strains after 1 hour and 24 hours under a load of 250 N are 8.0% or less in the braid.

6. The braid according to claim 1, wherein the high strength fiber (a) comprises at least one fiber selected from the group consisting of a liquid crystalline polyester fiber, an aramid fiber, a PBO fiber, an ultra-high molecular weight polyethylene fiber, and a high strength polyvinyl alcohol fiber.

7. The braid according to claim 6, wherein the high strength fiber (a) comprises a liquid crystalline polyester fiber.

8. The braid according to claim 1, wherein the colored synthetic fiber (b) comprises a spun-dyed fiber.

9. The braid according to claim 8, wherein the colored synthetic fiber (b) comprises a spun-dyed fiber comprising a pigment or a dye.

10. The braid according to claim 1, wherein the colored synthetic fiber (b) comprises at least one fiber selected from the group consisting of a polyester fiber, a polyolefin fiber, a polyamide fiber, and a polyvinyl alcohol fiber.

11. A fiber product comprising the braid according to claim 1.

12. The braid according to claim 1, wherein the synthetic fiber (b) is colored such that the sheath part exhibits a black color.

13. The braid according to claim 1, wherein a strength of the braid is 600 N or more.

14. The braid according to claim 1, wherein a strength of the braid is 800 N or more.

15. The braid according to claim 1, wherein a strength of the braid is 800 N or more and 1,100 N or less.

16. The braid according to claim 1, wherein the high strength fiber (a) has the fineness of 600 to 2,300 dtex and the tensile strength of 20 cN/dtex or more.

17. The braid according to claim 1, wherein the colored synthetic fiber (b) has the fineness of 70 to 800 dtex and the tensile strength of 2 cN/dtex or more and less than 6 cN/dtex.

18. The braid according to claim 1, wherein a diameter of the braid is from 0.8 mm to 1.2 mm.

* * * * *